US011111661B2

(12) United States Patent
Han et al.

(10) Patent No.: US 11,111,661 B2
(45) Date of Patent: Sep. 7, 2021

(54) METHOD AND DEVICE FOR CONTROLLING WATER SPOUTING OF TOILET

(71) Applicant: BEIJING XIAOMI MOBILE SOFTWARE CO., LTD., Beijing (CN)

(72) Inventors: Jin Han, Beijing (CN); Han Wang, Beijing (CN); Ximing Zhang, Beijing (CN)

(73) Assignee: BEIJING XIAOMI MOBILE SOFTWARE CO., LTD., Beijing (CN)

( * ) Notice: Subject to any disclaimer, the term of this patent is extended or adjusted under 35 U.S.C. 154(b) by 137 days.

(21) Appl. No.: 16/275,187

(22) Filed: Feb. 13, 2019

(65) Prior Publication Data

US 2019/0284788 A1 Sep. 19, 2019

(30) Foreign Application Priority Data

Mar. 16, 2018 (CN) ..... 201810217940.4

(51) Int. Cl.
*E03D 9/02* (2006.01)
*E03D 5/10* (2006.01)

(52) U.S. Cl.
CPC ..... *E03D 9/02* (2013.01); *E03D 5/105* (2013.01); *E03D 2009/028* (2013.01); *E03D 2201/40* (2013.01)

(58) Field of Classification Search
CPC ..... E03D 5/105; E03D 9/02
USPC ..... 4/661
See application file for complete search history.

(56) References Cited

U.S. PATENT DOCUMENTS

| | | | | |
|---|---|---|---|---|
| 2014/0250577 | A1 | 9/2014 | Nakamura et al. | |
| 2018/0002911 | A1* | 1/2018 | Hall | E03D 5/105 |
| 2018/0258625 | A1* | 9/2018 | Leng | E03D 5/105 |

FOREIGN PATENT DOCUMENTS

| | | | |
|---|---|---|---|
| CN | 102216537 | A | 10/2011 |
| CN | 103422554 | A | 12/2013 |
| CN | 104032820 | A | 9/2014 |
| CN | 205742449 | U | 11/2016 |
| CN | 106894481 | A | 6/2017 |
| CN | 106930379 | A | 7/2017 |
| CN | 107740474 | A | 2/2018 |
| EP | 2775054 | A1 | 9/2014 |
| WO | 2016073651 | A1 | 5/2016 |

OTHER PUBLICATIONS

European Search Report in the European application No. 19162137.4, dated Jul. 22, 2019.
First Office Action of the Chinese application No. 201810217940.4, dated Apr. 30, 2019.

* cited by examiner

*Primary Examiner* — Christine J Skubinna
(74) *Attorney, Agent, or Firm* — Syncoda LLC; Feng Ma

(57) ABSTRACT

A method for controlling water spouting of a toilet includes: a target region where a foreign object exists is determined from multiple predetermined regions in the toilet; a target water spout corresponding to the target region is determined according to pre-stored correspondences between the multiple regions in the toilet and water spouts for flushing the multiple regions; and the target water spout is controlled to spout water.

20 Claims, 11 Drawing Sheets

METHOD AND DEVICE FOR CONTROLLING WATER SPOUTING OF TOILET

CROSS-REFERENCE TO RELATED APPLICATION

This application claims the priority to Chinese Patent Application No. 201810217940.4, filed on Mar. 16, 2018, the disclosure of which is hereby incorporated by reference in its entirety.

BACKGROUND

Toilet is a bathroom product essential to people's lives. At present, a flushing manner for a toilet is that water flows out uniformly from several water outlets in an upper circumference of the toilet to flush the waste.

SUMMARY

The present disclosure generally relates to the field of smart home, and particularly to a method and device for controlling water spouting of a toilet.

According to a first aspect of embodiments of the present disclosure, a method for controlling water spouting of a toilet is provided, which is applied to the toilet, the toilet including multiple water spouts and the method including that: a target region where a foreign object exists is determined from multiple predetermined regions in the toilet; a target water spout corresponding to the target region is determined according to pre-stored correspondences between the multiple regions in the toilet and the multiple water spouts for flushing the multiple regions; and the target water spout is controlled to spout water.

According to a second aspect of the embodiments of the present disclosure, a terminal is provided, which includes a processor, and a memory arranged to store at least one instruction for the processor, the processor being arranged to: determine a target region where a foreign object exists from a plurality of predetermined regions in the toilet; determine a target water spout corresponding to the target region according to pre-stored correspondences between the plurality of regions in the toilet and the plurality of water spouts for flushing the plurality of regions; and control the target water spout to spout water.

According to a third aspect of the embodiments of the present disclosure, a non-transitory computer-readable storage medium having stored thereon at least one instruction, the instruction being loaded and executed by a processor to implement the method for controlling water spouting of the toilet according to the first aspect.

It should be understood that the above general descriptions and detailed descriptions below are only exemplary and explanatory and not intended to limit the present disclosure.

BRIEF DESCRIPTION OF THE DRAWINGS

The accompanying drawings referred to in the specification are a part of this disclosure, and provide illustrative embodiments consistent with the disclosure and, together with the detailed description, serve to illustrate some embodiments of the disclosure.

Specific embodiments of the present disclosure have been illustrated through the above accompanying drawings and more detailed descriptions will be made below. These accompanying drawings and textual descriptions are intended not to limit the scope of the concept of the present disclosure in any manner but to explain the concept of the present disclosure to those of ordinary in the art with reference to specific embodiments.

DETAILED DESCRIPTION

Various embodiments of the present disclosure are described below with specific examples, and other advantages and effects of the present disclosure can be easily understood by those skilled in the field of technology from the contents disclosed in this specification. The following description refers to the accompanying drawings in which same numeral references in different drawings may represent the same or similar elements unless otherwise indicated.

Apparently, the described embodiments are only a part of embodiments in the present disclosure, rather than all of them. The present disclosure can also be implemented or applied through different specific embodiments, and various details of the specification can also be modified or changed based on different viewpoints and applications without departing from the spirit of the present disclosure.

The inventors of the present disclosure have recognized that, although the waste may be flushed down by a conventional toilet, a flushing force of the water flow is not so strong and some waste may remain in a certain region of the toilet. In such a flushing manner, it is difficult to flush the remaining waste away at a time. If on the other hand it is repeatedly flushed, a large amount of water is required to flush the remaining waste, and too much water may be consumed.

Some embodiments of the present disclosure provide a method for controlling water spouting of a toilet, which is applied to the toilet. The method may be executed through a terminal.

Figure 1:
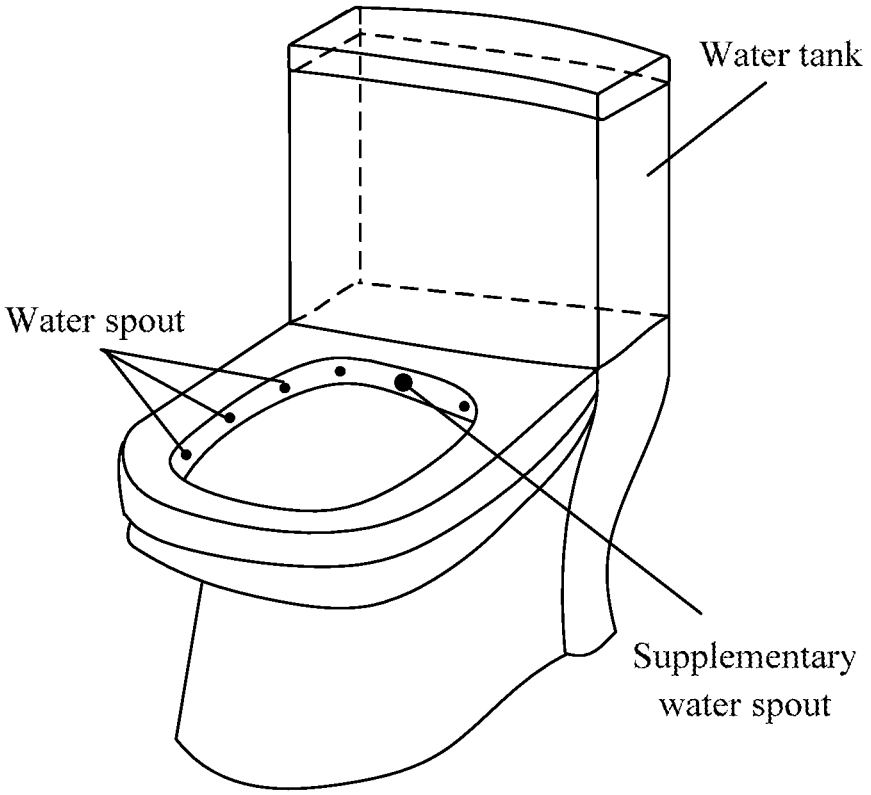
FIG. 1 is a structure diagram of a toilet according to some embodiments.

The toilet may include multiple water spouts, at least one supplementary water spout, a toilet base and a water tank. As illustrated in FIG. 1, the multiple water spouts are uniformly distributed in an upper circumference of an inner region of the toilet base, and the at least one supplementary water spout may be formed in a position, close to the water tank, of the upper circumference of the inner region of the toilet base.

The terminal may include members such as a processor and memory. The processor may be a central processing unit (CPU) and the like, and may be configured to control a foreign object detection member to start detecting, determine a target water spout, control the target water spout to spout water, control the target water spout to stop spouting water and the like. The memory may be a random-access memory (RAM), a flash drive, and the like, and may be configured to store received data, data required by a processing process, data generated in the processing process and the like, for example, a water spouting triggering event, correspondences between regions in the toilet and the water spouts for flushing the regions, a water spout for a target account, a default water spout, a first preset duration and a second preset duration.

The terminal may further include a screen, a transceiver, an image detection member, an audio output member, an audio input member and the like. The screen may be configured to display an account login interface and the like. The transceiver may be configured to perform data transmission with other equipment and may include an antenna, a matching circuit, a modem and the like. The image detection member may be a camera and the like. The audio output member may be a sound box, an earphone and the like. The audio input member may be a microphone (MIC) and the like.

Figure 2:
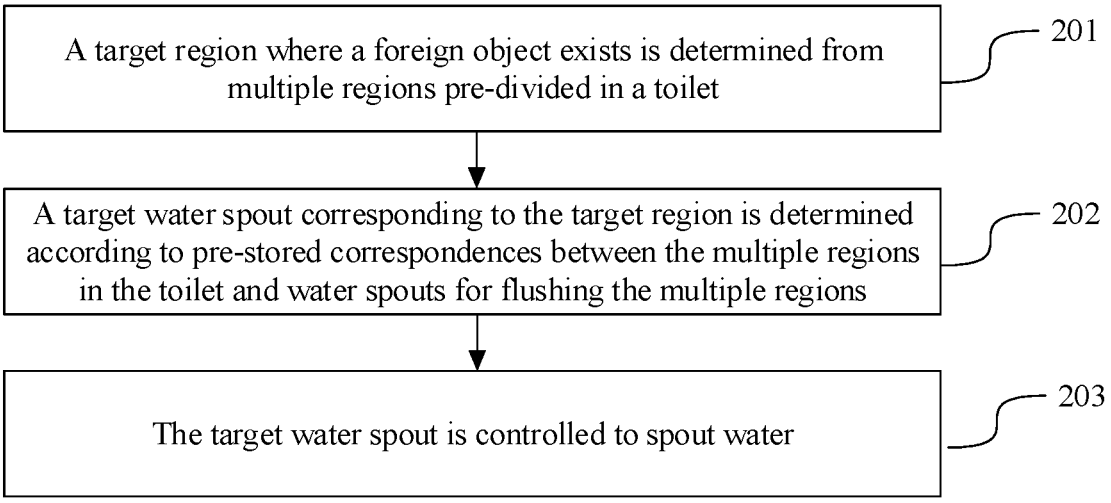
FIG. 2 is a flowchart showing a method for controlling water spouting of a toilet according to some embodiments.

A processing flow illustrated in FIG. 2 will be described below in combination with some specific implementations in detail. The process may include the following operations.

In operation 201, a target region where a foreign object exists is determined from multiple predetermined regions in the toilet.

In implementations, for achieving an effect of completely cleaning the interior of the toilet bowl, those of ordinary in the art may pre-divide the toilet into the multiple regions, and the terminal detects the region where the foreign object exists in the multiple regions in the toilet and determines the region where the foreign object exists as the target region. In such a manner, the target region may be pertinently flushed during flushing.

In some embodiments, a specific process of the above operation may be as follows: upon detection of a water spouting triggering event, a foreign object detection member is started; and the target region where the foreign object exists in the multiple predetermined regions in the toilet is detected through the foreign object detection member.

In implementations, a user may manually start an intelligent detection function of the toilet. For example, the user may press a flushing button after using the toilet. In this case, the flushing button is pressed to trigger the water spouting triggering event. A capacitance sensor is arranged at the flushing button, and the capacitance sensor is configured to detect whether the flushing button is pressed or not. When the flushing button is pressed, the terminal may detect the water spouting triggering event and trigger the foreign object detection member to be started. The multiple regions in the toilet are detected through the foreign object detection member to finally determine the region where the foreign object exists in the multiple regions and determine the region where the foreign object exists as the target region.

It is to be noted that the foreign object detection member may be an image capturing member, an infrared detection member or a sonar detection member.

When the foreign object detection member is an image capturing member, for example, a smart camera, the image capturing member, after being started, shoots a real-time image of an inner region of the toilet according to a preset period, acquires a pre-stored reference image of the inner region, which is completely clean, of the toilet, performs region division on the real-time image and the reference image according to a preset region division manner, compares an image of each region in the real-time image with an image of a corresponding region in the reference image one by one and, if a similarity between the image of each region in the real-time image and the image of the corresponding region in the reference image is more than or equal to a preset similarity threshold value, determines that the interior of the toilet is clean at present.

If the similarity between the image of a certain region in the real-time image and the image of the corresponding region in the reference image is lower than the preset similarity threshold value, it may be determined that a foreign object exists in the region, and the terminal determines the region as a target region.

Figure 3:
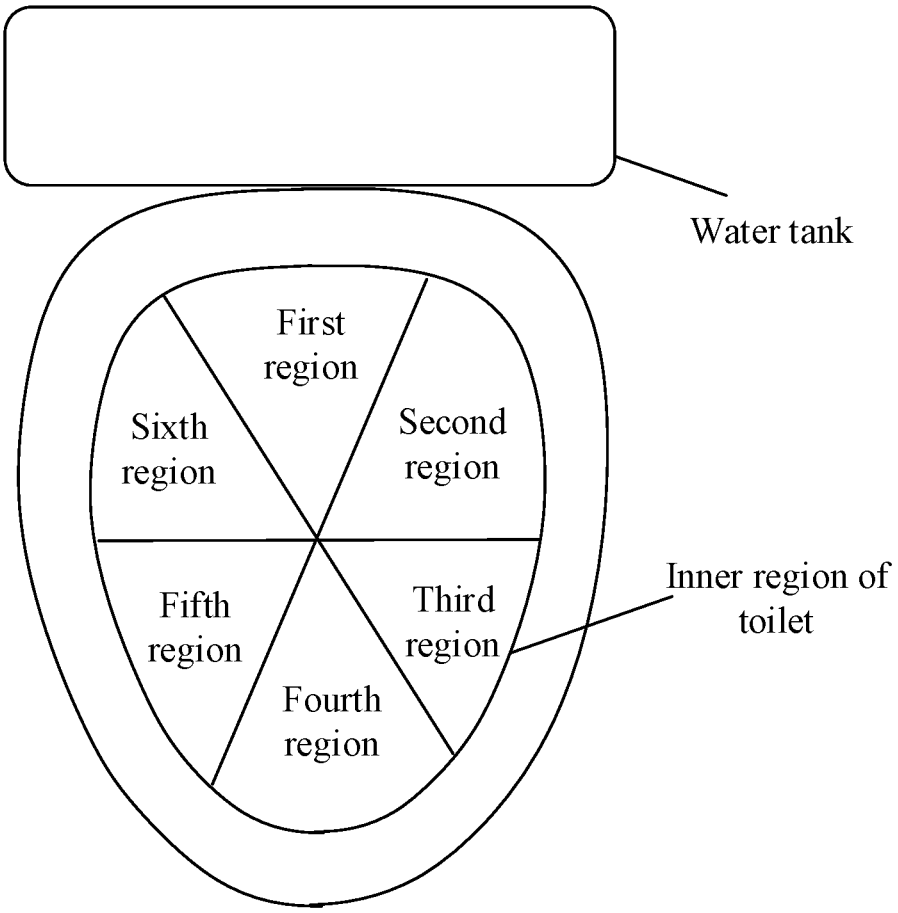
FIG. 3 is schematic diagram illustrating a scenario where water spouting of a toilet is controlled according to some embodiments.

For example, the preset region division manner is to uniformly divide the interior of the toilet into six regions, i.e., a first region to a sixth region. As illustrated in FIG. 3, the image capturing member, after shooting the real-time image, compares each of the six regions in the real-time image with a respective one of the six regions in the reference image.

When a comparison result is that a similarity between each of regions, namely the first region to fifth region, in the real-time image and a respective one in the reference image is more than or equal to the preset similarity threshold value and a similarity between the sixth region in the real-time image and the sixth region in the reference image is lower than the preset similarity threshold value, the terminal may determine that the sixth region is the target region.

When the foreign object detection member is an infrared detection member, for example, the interior of the toilet is divided into an even number of regions, every two regions to which light may be perpendicularly incident are set as a group of corresponding regions, at least one infrared sensor is arranged in each region, and the infrared sensors in each group of corresponding regions are set as mutually irradiated infrared sensors.

Upon detection of the water spouting triggering event, the terminal controls each infrared sensor to emit infrared rays. When the infrared sensor in a certain region do not receive any infrared ray but the infrared sensor in a region corresponding to the region may receive infrared rays, it is indicated that the infrared sensor in the region is covered by the foreign object, and in such a case, the terminal may determine the region as the target region where the foreign object exists.

When the foreign object detection member is a sonar detection member, for example, a sonar detector, the terminal may determine a position of the foreign object through the sonar detection member, determine the region where the foreign object exists and finally take the region as the target region.

It is to be noted that, in this operation, the user manually starts the intelligent detection function of the toilet, for example, the user presses the flushing button. In addition, the intelligent detection function of the toilet may also be started in a manner of keeping it on, voice-operated starting, light-operated starting and the like. There are no limits made thereto in the present disclosure.

In operation 202, a target water spout corresponding to the target region is determined according to pre-stored correspondences between the regions in the toilet and the water spouts for flushing the regions.

In implementations, for achieving an effect that pertinently flushing the region where the foreign object exists, those of ordinary in the art, after dividing the toilet into the multiple regions, may set at least one water spout for each region. In such a manner, there exist the correspondences between the regions in the toilet and the water spouts. Those of ordinary in the art may store the correspondences between the regions in the toilet and the water spouts for flushing the regions in the terminal in form of a correspondence table, for example in the form of the following Table 1.

TABLE 1

| Region | Water spout |
|---|---|
| First region | First water spout |
| Second region | Second water spout |
| Third region | Third water spout |

The terminal, upon determination of the target region according to the abovementioned operation, may search the correspondence table for a water spout corresponding to the target region according to the target region and take the water spout corresponding to the target region as the target water spout.

In operation 203, the target water spout is controlled to spout water.

In some embodiments, when the water spout is controlled to spout water, for saving water resources, a specific extent of the foreign object to be flushed may be determined. In such a manner, the water spout is not required to swing and flush the whole target region and is only required to repeatedly flush the foreign object. Specifically, the target region where the foreign object exists in the multiple predetermined regions in the toilet and the extent of the foreign object in the target region are detected; a swinging angle range of the target water spout is determined according to the extent of the foreign object in the target region; and the target water spout is controlled to swing in the swinging angle range and spout water.

In implementations, upon detection of the target region where the foreign object exists in the multiple predetermined regions in the toilet through the abovementioned operation, the extent of the foreign object in the target region may further be determined. Then the swinging angle range where the target water spout is required to swing when swinging to spout water is further calculated through the extent of the foreign object in the target region, an angle value in the swinging angle range being an angle between an edge of the foreign object and a certain fixed edge line of the target region. Then, a starting direction of the target water spout may be regulated to a maximum value or minimum value of the swinging angle range, then the terminal controls the target water spout to spout water, during spouting water, the target water spout reciprocally swings in the swinging angle range.

Figure 4:
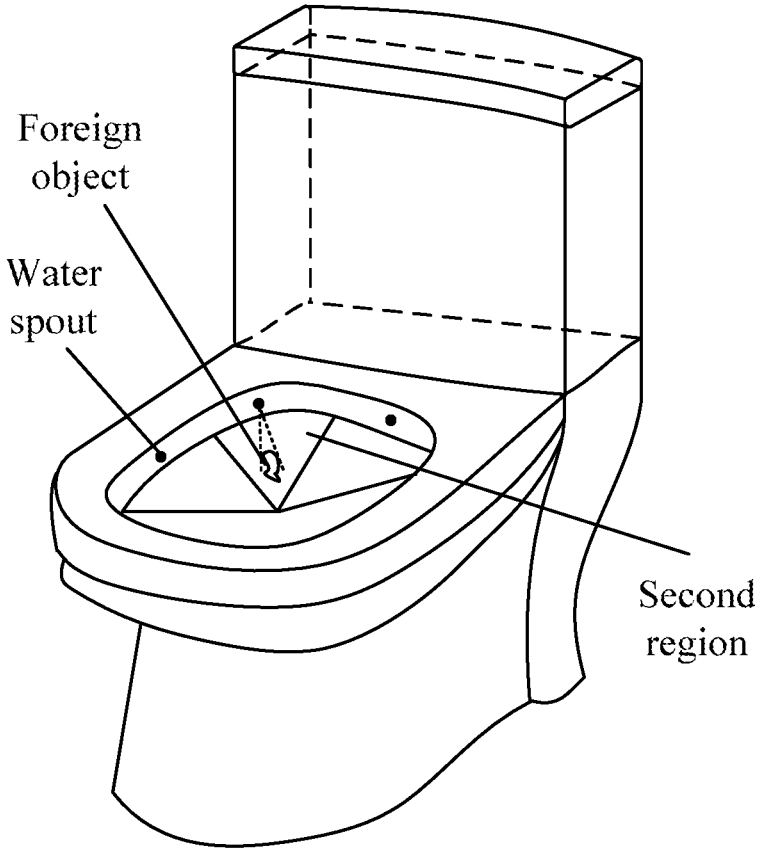
FIG. 4 is schematic diagram illustrating a scenario where water spouting of a toilet is controlled according to some embodiments.

For example, as illustrated in FIG. 4, the terminal detects that the foreign object exists in a second region in the multiple regions in the toilet, determines the second region as the target region and simultaneously determines an extent of the foreign object in the second region. The extent may adopt a coordinate form and may also adopt a form of relative extent between the foreign object and the second region. There are no limits made thereto in the present disclosure.

For example, the terminal determines according to the extent that the swinging angle range is [30°, 80°], the terminal regulates the starting direction of the target water spout into a direction forming 30° with a left edge of the second region or regulates the starting direction of the target water spout into a direction forming 80° with the left edge of the second region, and then the target water spout cyclically swings to spout water within [30°, 80°].

In some embodiments, considering that a water amount of the water spout may be relatively small and a relatively long time is required to flush waste away, at least one supplementary water spout may be added on the basis of the abovementioned solution of controlling the water spout to spout water. A water spouting impulsion force of the supplementary water spout may be weaker than that of the abovementioned water spout, but the water flow of the supplementary water spout is required to be larger than that of the abovementioned water spout. In such a manner, when the terminal detects the water spouting triggering event, the target water spout is controlled to spout water according to the abovementioned operations, and meanwhile, the supplementary water spout is controlled to spout water for a first preset duration. Therefore, the toilet may be completely cleaned at a time.

Figure 5:
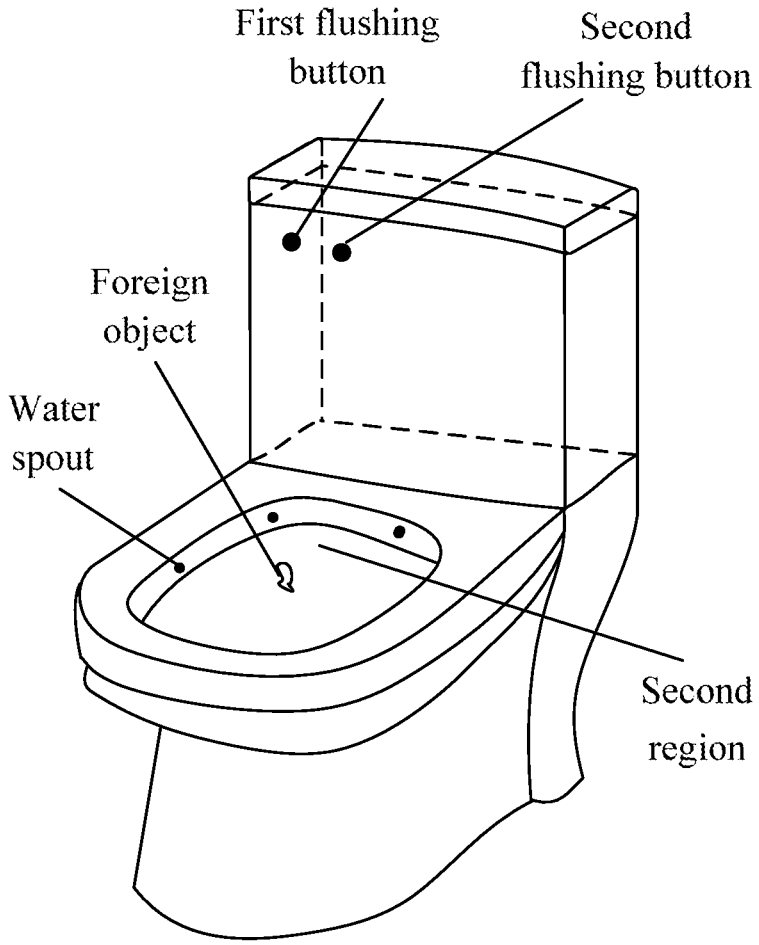
FIG. 5 is schematic diagram illustrating a scenario where water spouting of a toilet is controlled according to some embodiments.

The first preset duration may be a numerical value preset by those of ordinary in the art. Further, multiple preset numerical values may be preset by those of ordinary in the art, and each of the multiple preset numerical values corresponds to a respective button. For example, two flushing buttons are arranged on the toilet, a preset duration corresponding to the first flushing button is 1s and a preset duration corresponding to the second flushing button is 2s. As illustrated in FIG. 5, in such a case, the terminal may determine the preset duration corresponding to the flushing button pressed by the user at first and control the supplementary water spout to spout water according to the preset duration. In addition, the first preset duration may also be determined according to a duration for which the user presses the flushing button. There are no limits made thereto in the present disclosure.

In some embodiments, there may be many methods for controlling the target water spout to stop spouting water, including, but not limited to, the following approaches for stopping spouting water.

In a first approach, upon detection of a water spouting duration of the target water spout reaches a third preset duration, the target water spout is controlled to stop spouting water. Those of ordinary in the art may determine a most reasonable preset duration as the third preset duration for the water spout according to multiple test results of water spouting of the water spout, timing is started when the target water spout starts spouting water, and when the water spouting duration of the target water spout reaches the third preset duration, the terminal may control the target water spout to stop spouting water.

In a second approach, upon detection of a spouted water amount of the target water spout reaches a preset spouted water amount, the target water spout is controlled to stop spouting water. Those of ordinary in the art may determine a relatively reasonable spouted water amount according to multiple test results of water spouting of the water spout to ensure that, when water is spouted by the spouted water amount, the foreign object on the toilet may be completely flushed without excessive water resource waste, and those of ordinary in the art set the spouted water amount as the preset spouted water amount. When the spouted water amount of the target water spout reaches the preset spouted water amount, the terminal may control the target water spout to stop spouting water.

In a third approach, upon detection of absence of foreign object in the target region, the target water spout is controlled to stop spouting water. For ensuring that the toilet may be completely cleaned, the terminal may also keep periodically detecting the regions in the toilet after the target water spout starts spouting water, the terminal controls the target water spout to spout water as long as detecting that the foreign object exists in the target region, the terminal controls the target water spout to stop spouting water upon detection of the absence of the foreign object in the target region, and meanwhile, the terminal stops detecting the regions in the toilet.

It is to be noted that, in the three approaches, the first approach may be combined with the third approach for use. In this case, the terminal keeps periodically detecting the regions in the toilet after the target water spout spouts water, the terminal controls the target water spout to spout water as long as detecting that the foreign object exists in the target region, and when the water spouting duration of the target water spout reaches the third preset duration, the target water spout is controlled to stop spouting water even though it is detected that the foreign object still exists in the target region. With this approach, the problem that the target water spout keeps spouting water when the foreign object cannot be flushed away may be solved, and a water resource waste problem may be avoided.

In addition, the second approach may also be combined with the third approach for use. In this case, the terminal keeps periodically detecting the regions in the toilet after the target water spout spouts water, the terminal controls the target water spout to spout water as long as detecting that the foreign object exists in the target region, and when the spouted water amount of the target water spout reaches the preset spouted water amount, the target water spout is controlled to stop spouting water even though it is detected that the foreign object still exists in the target region. By this approach, the problem that the target water spout keeps spouting water when the foreign object cannot be flushed away may be solved, and the water resource waste problem may be avoided.

In some embodiments, to save electricity, a default water spout may be set to avoid the regions in the toilet being detected every time. Specifically, a target account currently logged on to the toilet is acquired, and the target account and one or more target water spouts corresponding to the target account are recorded; when a first number of times for which the toilet with the target account logged on has been triggered to spout water reaches a preset number of times, a water spout which has been triggered to spout water for a second number of times is determined from the recorded one or more water spouts corresponding to the target account, where a ratio of the second number to the first number exceeds a preset ratio, and the determined water spout is taken as a default water spout corresponding to the target account; and upon detection of the water spouting triggering event again, when an account currently logged on to the toilet is the target account, the default water spout is controlled to spout water for a second preset duration.

In implementations, because of different characteristics and using habits of users, for a certain user, a region, where a foreign object is likely to remain, of a certain toilet may be fixed, that is, a water spout awakened for flushing every time may be fixed. Therefore, the terminal may record a water spout using record of each user to determine a default water spout corresponding to each user.

A user may log on with his/her own account when using the toilet, and a manner for logging with the account may be a manner of fingerprint login, face recognition login, login through an application program in a mobile terminal or the like. There are no limits made thereto in the present disclosure.

After acquiring the target account logged by the user, the terminal records the target account of the user and one or more target water spouts used by the user for flushing the toilet. When a number of times for which the toilet with the target account logged on has been trigged to spout water reaches a preset number of times, it is indicated that the collected records corresponding to the target account have been sufficient to determine the water spout fixedly used for the user.

In this case, the terminal acquires the recorded water spouts used for the target account and determines a water spout from the recorded target water spouts, where a ratio of the recording number of times of the water spout to the number of times for which the toilet has been trigged to spout water exceeds a preset ratio, and it is indicated that the water spout may be a water spout fixedly used for the user corresponding to the target account, so that the water spout may be determined as a default water spout corresponding to the target account and the target account and the default water spout corresponding to the target account are stored.

After the default water spout corresponding to the target account is set, when the terminal detects the water spouting triggering event again in a state of login with the target account, the pre-stored default water spout corresponding to the target account is acquired, then the terminal controls the default water spout to spout water, and when the water spouting duration reaches the second preset duration, the terminal controls the default water spout to stop spouting water.

In some embodiments of the present disclosure, the target region where the foreign object exists in the multiple predetermined regions in the toilet is detected; the target water spout corresponding to the target region is determined according to the pre-stored correspondences between the multiple regions in the toilet and the multiple water spouts for flushing the multiple regions; and the target water spout is controlled to spout water. In such a manner, the foreign object remaining in the toilet may be flushed away at a time without repeated flushing, and water resource waste may be reduced.

Figure 6:
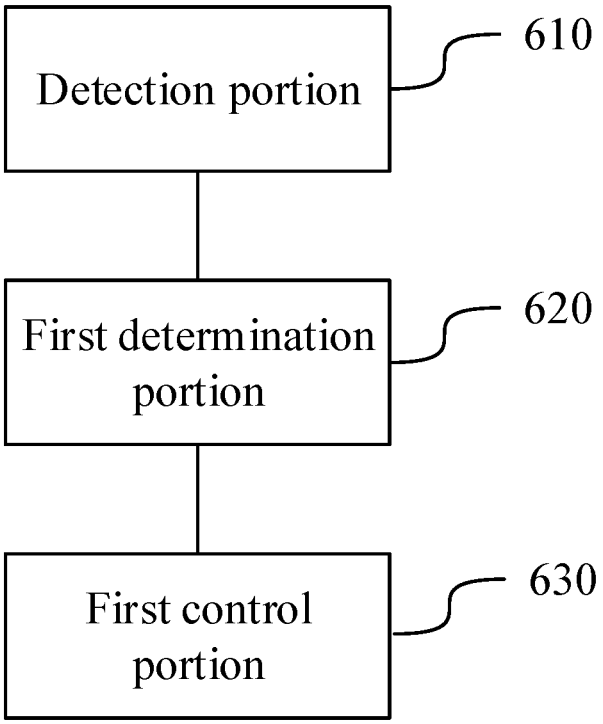
FIG. 6 is structure diagram of a device for controlling water spouting of a toilet according to some embodiments.

Some other embodiments of the present disclosure provide a device for controlling water spouting of a toilet, which is applied to the toilet. As illustrated in FIG. 6, the device includes a detection portion 610, a first determination portion 620 and a first control portion 630.

The detection portion 610 is configured to determine a target region where a foreign object exists from multiple regions pre-divided in the toilet.

The first determination portion 620 is configured to determine a target water spout corresponding to the target region according to pre-stored correspondences between the multiple regions in the toilet and the multiple water spouts for flushing the multiple regions.

The various device components, blocks, or portions may have modular configurations, or are composed of discrete components, but nonetheless may be referred to as "modules" in general. In other words, the "modules" referred to herein may or may not be in modular forms.

The first control portion 630 is configured to control the target water spout to spout water.

In some embodiments, the detection portion 610 is configured to: upon detection of a water spouting triggering event, start a foreign object detection member; and detect the target region where the foreign object exists in the multiple regions pre-divided in the toilet through the foreign object detection member.

In some embodiments, the foreign object detection member may include an image capturing member, an infrared detection member or a sonar detection member.

Figure 7:
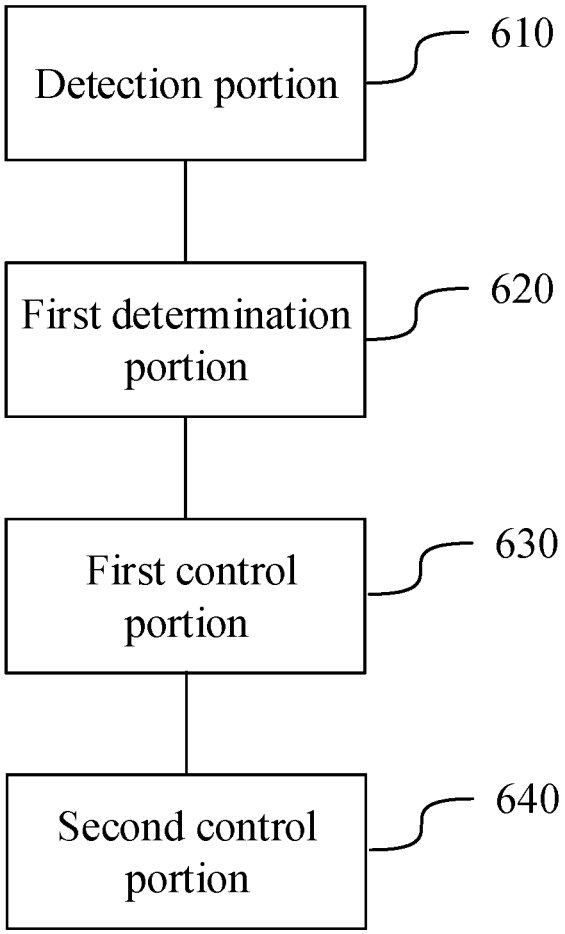
FIG. 7 is structure diagram of a device for controlling water spouting of a toilet according to some embodiments.

In some embodiments, the toilet may further include at least one supplementary water spout; and as illustrated in FIG. 7, the device may further include: a second control portion 640, configured to, upon detection of the water spouting triggering event, control the supplementary water spout to spout water for a first preset duration.

Figure 8:
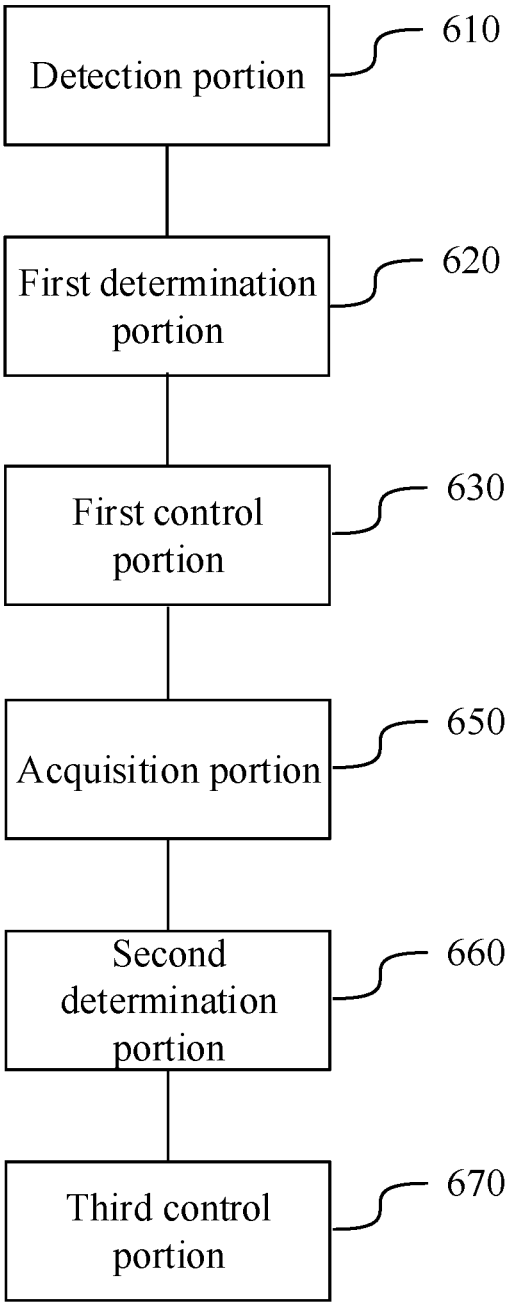
FIG. 8 is structure diagram of a device for controlling water spouting of a toilet according to some embodiments.

In some embodiments, as illustrated in FIG. 8, the device may further include: an acquisition portion 650, configured to acquire a target account currently logged on to the toilet and record the target account and one or more target water spouts corresponding to the target account; a second determination portion 660, configured to, when a first number of times for which the toilet with the target account logged on has been triggered to spout water reaches a preset number of times, determine a water spout, which has been triggered to spout water for a second number of times, from the recorded one or more water spouts corresponding to the target account, where a ratio of the second number to the first number exceeds a preset ratio, and take the determined water spout as a default water spout corresponding to the target account; and a third control portion 670, configured to, upon detection of the water spouting triggering event again, when an account currently logged on to the toilet is the target account, control the default water spout to spout water for a second preset duration.

Figure 9:
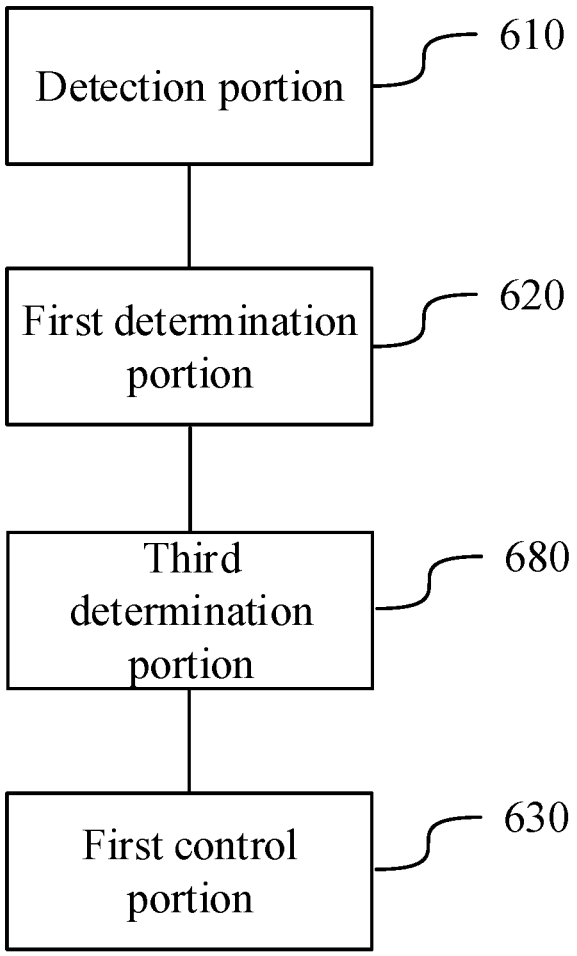
FIG. 9 is structure diagram of a device for controlling water spouting of a toilet according to some embodiments.

In some embodiments, the detection portion 610 is configured to: detect the target region where the foreign object exists in the multiple regions pre-divided in the toilet and an extent of the foreign object in the target region; as illustrated in FIG. 9, the device may further include: a third determination portion 680, configured to determine a swinging angle range of the target water spout according to the extent of the foreign object in the target region; and the first control portion 630 may be further configured to: control the target water spout to swing in the swinging angle range and spout water.

Figure 10:
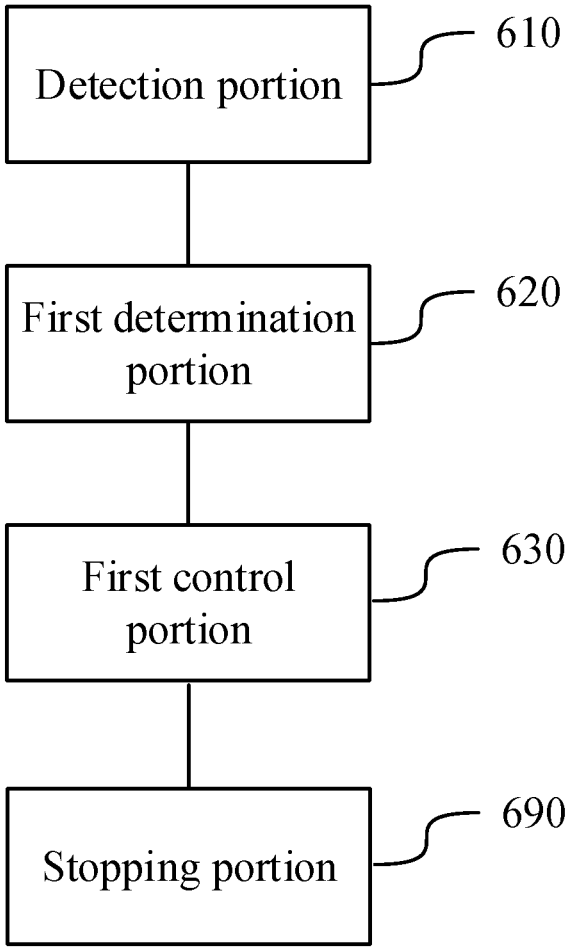
FIG. 10 is structure diagram of a device for controlling water spouting of a toilet according to some embodiments.

In some embodiments, as illustrated in FIG. 10, the device may further include:

a stopping portion 690, configured to, after the target water spout is controlled to spout water, upon detection of a water spouting duration of the target water spout reaches a third preset duration, control the target water spout to stop spouting water; or, the stopping portion, configured to, upon detection of a spouted water amount of the target water spout reaches a preset spouted water amount, control the target water spout to stop spouting water; or, the stopping portion, configured to, upon detection of absence of the foreign object in the target region, control the target water spout to stop spouting water.

With respect to the device in the above embodiment, the specific manners for performing operations for individual portions therein have been described in detail in the embodiment regarding the method, which will not be elaborated herein.

In the embodiments of the present disclosure, the target region where the foreign object exists in the multiple regions pre-divided in the toilet is detected; the target water spout corresponding to the target region is determined according to the pre-stored correspondences between the multiple regions in the toilet and the multiple water spouts for flushing the multiple regions; and the target water spout is controlled to spout water. In such a manner, the foreign object remaining in the toilet may be flushed away at a time without repeated flushing, and water resource waste may be reduced.

It is to be noted that, when water spouting of the toilet is controlled, the device for controlling water spouting of the toilet in the above embodiments is only described with division of each abovementioned functional portion as an example and, during a practical application, the abovementioned functions may be allocated to different functional portions for realization according to a requirement, that is, an internal structure of a terminal is divided into different functional portions to realize all or part of the functions described above.

In addition, the device for controlling water spouting of the toilet in the above embodiments belongs to the same concept of the method embodiments for controlling water spouting of the toilet and details about its specific implementation process refer to the method embodiment and will not be elaborated herein.

Some other embodiments of the present disclosure provide structures of a terminal.

Figure 11:
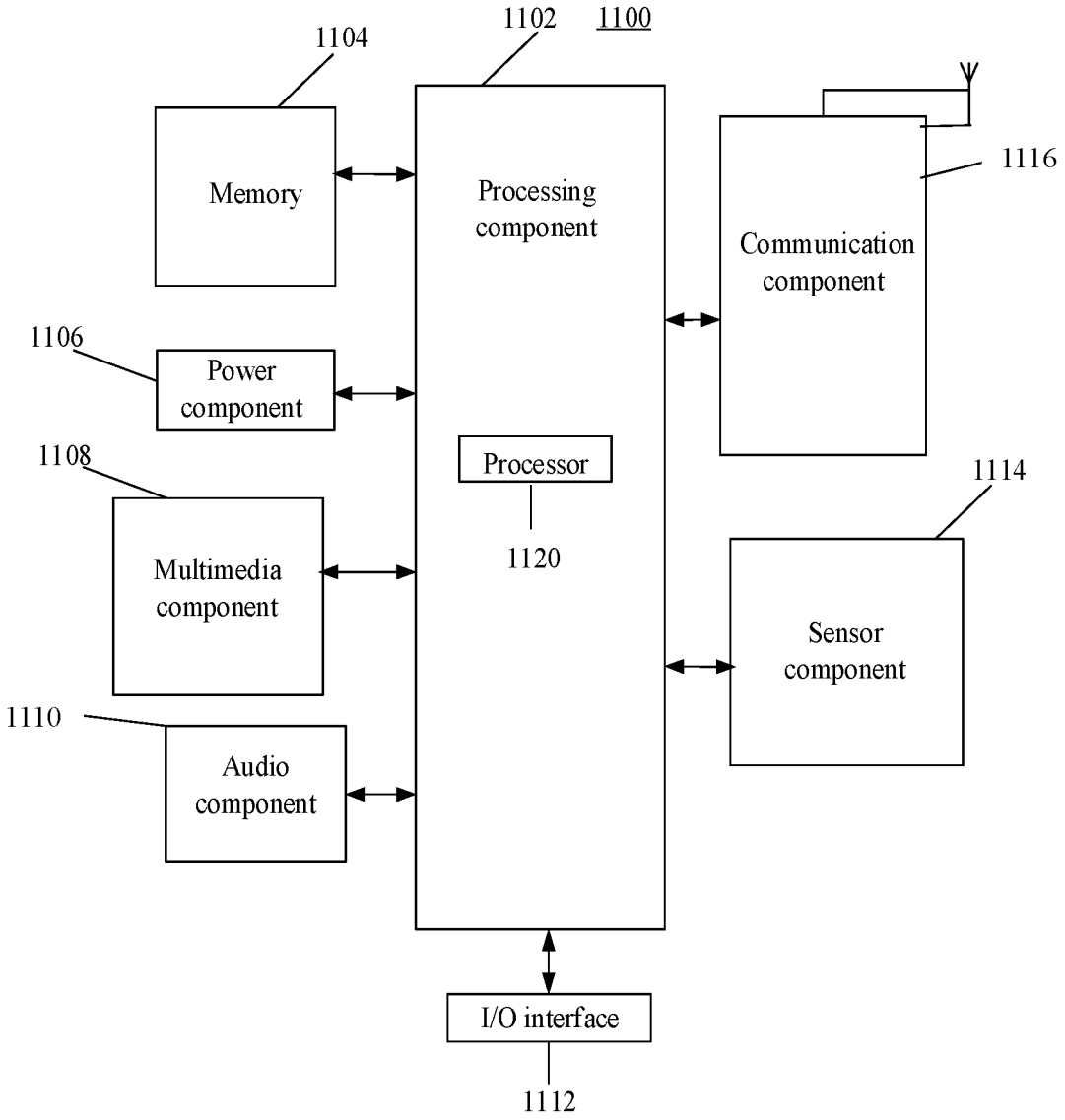
FIG. 11 is a structure diagram of a terminal according to some embodiments.

Referring to FIG. 11 for an example, the terminal 1100 may include one or more of the following components: a processing component 1102, a memory 1104, a power component 1106, a multimedia component 1108, an audio component 1110, an input/output (I/O) interface 1112, a sensor component 1114, and a communication component 1116.

The processing component 1102 typically controls overall operations of the terminal 1100, such as the operations associated with display, telephone calls, data communications, camera operations, and recording operations. The processing component 1102 may include one or more processors 1120 to execute instructions to perform all or part of the steps in the abovementioned method. Moreover, the processing component 1102 may include one or more portions which facilitate interaction between the processing component 1102 and the other components. For instance, the processing component 1102 may include a multimedia portion to facilitate interaction between the multimedia component 1108 and the processing component 1102.

The memory 1104 is configured to store various types of data to support the operation of the terminal 1100. Examples of such data include instructions for any application programs or methods operated on the terminal 1100, contact data, phonebook data, messages, pictures, video, etc. The memory 1104 may be implemented by any type of volatile or non-volatile memory devices, or a combination thereof, such as a static random-access memory (SRAM), an electrically erasable programmable read-only memory (EEPROM), an erasable programmable read-only memory (EPROM), a programmable read-only memory (PROM), a read-only memory (ROM), a magnetic memory, a flash memory, and a magnetic or optical disk.

The power component 1106 provides power for various components of the terminal 1100. The power component 1106 may include a power management system, one or more power supplies, and other components associated with generation, management and distribution of power for the audio output equipment 1100.

The multimedia component 1108 includes a screen providing an output interface between the terminal 1100 and a user. In some embodiments, the screen may include a liquid crystal display (LCD) and a touch panel (TP). If the screen includes the TP, the screen may be implemented as a touch screen to receive an input signal from the user. The TP includes one or more touch sensors to sense touches, swipes and gestures on the TP. The touch sensors may not only sense a boundary of a touch or swipe action but also detect a duration and pressure associated with the touch or swipe action. In some embodiments, the multimedia component 1108 includes a front camera and/or a rear camera. The front camera and/or the rear camera may receive external multimedia data when the terminal 1100 is in an operation mode, such as a photographing mode or a video mode. Each of the front camera and the rear camera may be a fixed optical lens system or have focusing and optical zooming capabilities.

The audio component 1110 is configured to output and/or input an audio signal. For example, the audio component 1110 includes a MIC, and the MIC is configured to receive an external audio signal when the audio output equipment 1100 is in the operation mode, such as a call mode, a recording mode and a voice recognition mode. The received audio signal may further be stored in the memory 1104 or sent through the communication component 1116.

The I/O interface 1112 provides an interface between the processing component 1102 and a peripheral interface portion, and the peripheral interface portion may be a keyboard, a click wheel, a button and the like. The button may include, but not limited to: a home button, a volume button, a starting button and a locking button.

The sensor component 1114 includes one or more sensors configured to provide status assessment in various aspects for the terminal 1100. For instance, the sensor component 1114 may detect an on/off status of the terminal 1100 and relative positioning of components, such as a display and small keyboard of the terminal 1100, and the sensor component 1114 may further detect a change in a position of the terminal 1100 or a component of the terminal 1100, presence or absence of contact between the user and the terminal 1100, orientation or acceleration/deceleration of the terminal 1100 and a change in temperature of the terminal 1100. The sensor component 1114 may include a proximity sensor configured to detect presence of an object nearby without any physical contact. The sensor component 1114 may also include a light sensor, such as a complementary metal oxide semiconductor (CMOS) or charge coupled device (CCD) image sensor, configured for use in an imaging application. In some embodiments, the sensor component 1114 may also include an acceleration sensor, a gyroscope sensor, a magnetic sensor, a pressure sensor or a temperature sensor.

The communication component 1116 is configured to facilitate wired or wireless communication between the terminal 1100 and other equipment. The terminal 1100 may access a communication-standard-based wireless network, such as a wireless fidelity (WiFi) network, a 2nd-generation (2G) or 3rd-generation (3G) network or a combination thereof. In some embodiments, the communication component 1116 receives a broadcast signal or broadcast associated information from an external broadcast management system through a broadcast channel. In some embodiments, the communication component 1116 further includes a near field communication (NFC) portion to facilitate short-range communication. For example, the NFC portion may be implemented on the basis of a radio frequency identification (RFID) technology, an infrared data association (IrDA) technology, an ultra-wideband (UWB) technology, a Bluetooth (BT) technology and another technology.

In some embodiments, the terminal 1100 may be implemented by one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors or other electronic components, and is configured to execute the abovementioned method.

In some embodiments, there is also provided a non-transitory computer-readable storage medium including an instruction, such as the memory 1104 including an instruction, and the instruction may be executed by the processor 1120 of the terminal 1100 to implement the abovementioned method. For example, the non-transitory computer-readable storage medium may be a ROM, a RAM, a compact disc read-only memory (CD-ROM), a magnetic tape, a floppy disc, optical data storage equipment and the like.

Some other embodiments of the present disclosure provide a computer-readable storage medium, in which at least one instruction is stored in the storage medium, the instruction being loaded and executed by a processor to implement the method for controlling water spouting of the toilet.

In the embodiment of the present disclosure, a target region where a foreign object exists in multiple regions pre-divided in the toilet is detected; a target water spout corresponding to the target region is determined according to pre-stored correspondences between the regions in the toilet and water spouts for flushing the regions; and the target water spout is controlled to spout water. In such a manner, the foreign object remaining in the toilet may be flushed away at one time without repeated flushing, and water resource waste may be reduced.

The terms "first" and "second" are used for descriptive purposes only and are not to be construed as indicating or implying a relative importance or implicitly indicating the number of technical features indicated. Thus, elements referred to as "first" and "second" may include one or more of the features either explicitly or implicitly. In the description of the present disclosure, "a plurality" indicates two or more unless specifically defined otherwise.

In the present disclosure, the terms "installed," "connected," "coupled," "fixed" and the like shall be understood broadly, and may be either a fixed connection or a detachable connection, or integrated, unless otherwise explicitly defined. These terms can refer to mechanical or electrical connections, or both. Such connections can be direct connections or indirect connections through an intermediate medium. These terms can also refer to the internal connections or the interactions between elements. The specific meanings of the above terms in the present disclosure can be understood by those of ordinary skill in the art on a case-by-case basis.

In the description of the present disclosure, the terms "one embodiment," "some embodiments," "example," "specific example," or "some examples," and the like may indicate a specific feature described in connection with the embodiment or example, a structure, a material or feature included in at least one embodiment or example. In the present disclosure, the schematic representation of the above terms is not necessarily directed to the same embodiment or example.

Moreover, the particular features, structures, materials, or characteristics described may be combined in a suitable manner in any one or more embodiments or examples. In addition, various embodiments or examples described in the specification, as well as features of various embodiments or examples, may be combined and reorganized.

In some embodiments, the control and/or interface software or app can be provided in a form of a non-transitory computer-readable storage medium having instructions stored thereon is further provided. For example, the non-transitory computer-readable storage medium may be a ROM, a RAM, a CD-ROM, a magnetic tape, a floppy disk, optical data storage equipment, a flash drive such as a USB drive or an SD card, and the like.

Implementations of the subject matter and the operations described in this disclosure can be implemented in digital electronic circuitry, or in computer software, firmware, or hardware, including the structures disclosed herein and their structural equivalents, or in combinations of one or more of them. Implementations of the subject matter described in this disclosure can be implemented as one or more computer programs, i.e., one or more portions of computer program instructions, encoded on one or more computer storage medium for execution by, or to control the operation of, data processing apparatus.

Alternatively, or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them.

Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, drives, or other storage devices). Accordingly, the computer storage medium may be tangible.

The operations described in this disclosure can be implemented as operations performed by a data processing apparatus on data stored on one or more computer-readable storage devices or received from other sources.

The devices in this disclosure can include special purpose logic circuitry, e.g., an FPGA (field-programmable gate array), or an ASIC (application-specific integrated circuit). The device can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The devices and execution environment can realize various different computing model infrastructures, such as web services, distributed computing, and grid computing infrastructures.

A computer program (also known as a program, software, software application, app, script, or code) can be written in any form of programming language, including compiled or interpreted languages, declarative or procedural languages, and it can be deployed in any form, including as a stand-alone program or as a portion, component, subroutine, object, or other portion suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more portions, sub-programs, or portions of code). A computer program can be deployed to be executed on one computer or on multiple computers that are located at one site or distributed across multiple sites and interconnected by a communication network.

The processes and logic flows described in this disclosure can be performed by one or more programmable processors executing one or more computer programs to perform actions by operating on input data and generating output. The processes and logic flows can also be performed by, and apparatus can also be implemented as, special purpose logic circuitry, e.g., an FPGA, or an ASIC.

Processors suitable for the execution of a computer program include, by way of example, both general and special purpose microprocessors, and any one or more processors of any kind of digital computer. Generally, a processor will receive instructions and data from a read-only memory, or a random-access memory, or both. Elements of a computer can include a processor configured to perform actions in accordance with instructions and one or more memory devices for storing instructions and data.

Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few.

Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented with a computer and/or a display device, e.g., a VR/AR device, a head-mount display (HMD) device, a head-up display (HUD) device, smart eyewear (e.g., glasses), LCD (liquid-crystal display), OLED (organic light emitting diode), TFT (thin-film transistor), plasma, other flexible configuration, or any other monitor for displaying information to the user and a keyboard, a pointing device, e.g., a mouse, trackball, etc., or a touch screen, touch pad, etc., by which the user can provide input to the computer.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

While this specification contains many specific implementation details, these should not be construed as limitations on the scope of any claims, but rather as descriptions of features specific to particular implementations. Certain features that are described in this specification in the context of separate implementations can also be implemented in combination in a single implementation. Conversely, various features that are described in the context of a single implementation can also be implemented in multiple implementations separately or in any suitable subcombination.

Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel processing may be utilized.

It is intended that the specification and embodiments be considered as examples only. Other embodiments of the disclosure will be apparent to those skilled in the art in view of the specification and drawings of the present disclosure. That is, although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the example embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

It will be appreciated that the present disclosure is not limited to the exact construction that has been described above and illustrated in the accompanying drawings, and that various modifications and changes may be made without departing from the scope thereof. It is intended that the scope of the present disclosure only be limited by the appended claims.

The invention claimed is:

1. A method for controlling water spouting of a toilet, applied to the toilet comprising a plurality of water spouts, wherein the plurality of water spouts are uniformly distributed in an inner region of a toilet base, and the method comprises:

determining a target region, among a plurality of predetermined regions, where a foreign object exists in the toilet;

determining a target water spout corresponding to the target region according to pre-stored correspondences between the plurality of regions in the toilet and the plurality of water spouts for flushing the plurality of regions; and controlling the target water spout to spout water.

2. The method according to claim 1, wherein the determining the target region, among the plurality of predetermined regions, where the foreign object exists in the toilet comprises:

upon detection of a water spouting triggering event, starting a foreign object detection member; and determining the target region, among the plurality of predetermined regions, where the foreign object exists the toilet through the foreign object detection member.

3. The method according to claim 2, wherein the foreign object detection member comprises an image capturing member, an infrared detection member or a sonar detection member.

4. The method according to claim 2, wherein:

the toilet further comprises at least one supplementary water spout; and the method further comprises:

upon detection of the water spouting triggering event, controlling the supplementary water spout to spout water for a first preset duration.

5. The method according to claim 2, further comprising:

acquiring a target account currently logged on to the toilet, and recording the target account and one or more target water spouts corresponding to the target account;

when a first number of times for which the toilet with the target account logged on has been triggered to spout water reaches a preset number of times, determining a water spout, which has been triggered to spout water for a second number of times, from the recorded one or more water spouts corresponding to the target account, wherein a ratio of the second number to the first number exceeds a preset ratio, and taking the determined water spout as a default water spout corresponding to the target account; and upon detection of the water spouting triggering event again, when an account currently logged on to the toilet is the target account, controlling the default water spout to spout water for a second preset duration.

6. The method according to claim 1, wherein:

the determining the target region, among the plurality of predetermined regions, where the foreign object exists the toilet comprises:

determining the target region, among the plurality of predetermined regions, where the foreign object exists in the toilet and an extent of the foreign object in the target region;

the method further comprises: determining a swinging angle range of the target water spout according to the extent of the foreign object in the target region; and the controlling the target water spout to spout water comprises:

controlling the target water spout to swing in the swinging angle range and spout water.

7. The method according to claim 1, further comprising: after controlling the target water spout to spout water, upon detection of a water spouting duration of the target water spout reaches a third preset duration, controlling the target water spout to stop spouting water; or, upon detection of a spouted water amount of the target water spout reaches a preset spouted water amount, controlling the target water spout to stop spouting water; or, upon detection of absence of the foreign object in the target region, controlling the target water spout to stop spouting water.

8. The method according to claim 2, wherein:

the determining the target region, among the plurality of predetermined regions, where the foreign object exists in the toilet comprises:

determining the target region, among the plurality of predetermined regions, where the foreign object exists in the toilet and an extent of the foreign object in the target region; and the method further comprises: determining a swinging angle range of the target water spout according to the extent of the foreign object in the target region; and the controlling the target water spout to spout water comprises:

controlling the target water spout to swing in the swinging angle range and spout water.

9. The method according to claim 3, wherein:

the determining the target region, among the plurality of predetermined regions, where the foreign object exists in the toilet comprises:

determining the target region, among the plurality of predetermined regions, where the foreign object exists in the toilet and an extent of the foreign object in the target region;

the method further comprises: determining a swinging angle range of the target water spout according to the extent of the foreign object in the target region; and the controlling the target water spout to spout water comprises:

controlling the target water spout to swing in the swinging angle range and spout water.

10. The method according to claim 4, wherein:

the determining the target region, among the plurality of predetermined regions, where the foreign object exists in the toilet comprises:

determining the target region, among the plurality of predetermined regions, where the foreign object exists in the toilet and an extent of the foreign object in the target region;

the method further comprises: determining a swinging angle range of the target water spout according to the extent of the foreign object in the target region; and the controlling the target water spout to spout water comprises:

controlling the target water spout to swing in the swinging angle range and spout water.

11. The method according to claim 5, wherein:

the determining the target region, among the plurality of predetermined regions, where the foreign object exists in the toilet comprises:

determining the target region, among the plurality of predetermined regions, where the foreign object exists in the toilet and an extent of the foreign object in the target region;

the method further comprises: determining a swinging angle range of the target water spout according to the extent of the foreign object in the target region; and the controlling the target water spout to spout water comprises:

controlling the target water spout to swing in the swinging angle range and spout water.

12. A terminal for controlling water spouting of a toilet, comprising:

a processor, and memory arranged to store at least one instruction for the processor, wherein the processor is arranged to:

determine a target region, among a plurality of predetermined regions, where a foreign object exists in the toilet, the toilet comprising a plurality of water spouts, wherein the plurality of water spouts are uniformly distributed in an inner region of a toilet base;

determine a target water spout corresponding to the target region according to pre-stored correspondences between the plurality of regions in the toilet and the plurality of water spouts for flushing the plurality of regions; and control the target water spout to spout water.

13. The terminal according to claim 12, wherein in order to determine the target region, among the plurality of predetermined regions, where the foreign object exists in the toilet, the processor is arranged to:

upon detection of a water spouting triggering event, start a foreign object detection member; and determine the target region, among the plurality of predetermined regions, where the foreign object exists in the toilet through the foreign object detection member.

14. The terminal according to claim 13, wherein the foreign object detection member comprises an image capturing member, an infrared detection member or a sonar detection member.

15. The terminal according to claim 13, wherein:

the toilet further comprises at least one supplementary water spout; and the processor is arranged to: upon detection of the water spouting triggering event, control the supplementary water spout to spout water for a first preset duration.

16. The terminal according to claim 13, wherein the processor is arranged to:

acquire a target account currently logged on to the toilet, and record the target account and one or more target water spouts corresponding to the target account;

when a first number of times for which the toilet with the target account logged on has been triggered to spout water reaches a preset number of times, determine a water spout, which has been triggered to spout water for a second number of times, from the recorded one or more water spouts corresponding to the target account, wherein a ratio of the second number to the first number exceeds a preset ratio, and take the determined water spout as a default water spout corresponding to the target account; and upon detection of the water spouting triggering event again, when an account currently logged on to the toilet is the target account, control the default water spout to spout water for a second preset duration.

17. The terminal according to claim 12, wherein the processor is arranged to:

determine the target region where, among the plurality of predetermined regions, the foreign object exists in the toilet and an extent of the foreign object in the target region;

determine a swinging angle range of the target water spout according to the extent of the foreign object in the target region; and control the target water spout to swing in the swinging angle range and spout water.

18. The terminal according to claim 12, wherein after controlling the target water spout to spout water, the processor is arranged to:

upon detection of a water spouting duration of the target water spout reaches a third preset duration, control the target water spout to stop spouting water; or, upon detection of a spouted water amount of the target water spout reaches a preset spouted water amount, control the target water spout to stop spouting water; or, upon detection of absence of the foreign object in the target region, control the target water spout to stop spouting water.

19. A non-transitory computer-readable storage medium having stored thereon at least one instruction, the instruction being loaded and executed by a processor to implement a method for controlling water spouting of a toilet, applied to the toilet comprising a plurality of water spouts, wherein the plurality of water spouts are uniformly distributed in an inner region of a toilet base, and the method comprises:

determining a target region, among a plurality of predetermined regions, where a foreign object exists in the toilet;

determining a target water spout corresponding to the target region according to pre-stored correspondences between the plurality of regions in the toilet and the plurality of water spouts for flushing the plurality of regions; and controlling the target water spout to spout water.

20. The non-transitory computer-readable storage medium according to claim 19, wherein determining the target region, among the plurality of predetermined regions, where the foreign object exists in the toilet comprises:

upon detection of a water spouting triggering event, starting a foreign object detection member; and determining the target region where, among the plurality of predetermined regions, the foreign object exists in the toilet through the foreign object detection member.

* * * * *